US008136919B2

(12) United States Patent
Maru et al.

(10) Patent No.: US 8,136,919 B2
(45) Date of Patent: Mar. 20, 2012

(54) INK JET RECORDING APPARATUS AND INK JET RECORDING HEAD

(75) Inventors: Akiko Maru, Tokyo (JP); Kiichiro Takahashi, Yokohama (JP); Tetsuya Edamura, Kawasaki (JP); Minoru Teshigawara, Yokohama (JP); Takatoshi Nakano, Tokyo (JP); Hiroshi Taira, Chofu (JP)

(73) Assignee: Canon Kabushiki Kaisha, Tokyo (JP)

( * ) Notice: Subject to any disclaimer, the term of this patent is extended or adjusted under 35 U.S.C. 154(b) by 407 days.

(21) Appl. No.: 12/490,267

(22) Filed: Jun. 23, 2009

(65) Prior Publication Data

US 2009/0315944 A1 Dec. 24, 2009

(30) Foreign Application Priority Data

Jun. 24, 2008 (JP) ..... 2008-165075

(51) Int. Cl.
*B41J 2/21* (2006.01)

(52) U.S. Cl. ..... 347/40

(58) Field of Classification Search ..... 347/20, 347/37, 40, 43
See application file for complete search history.

(56) References Cited

U.S. PATENT DOCUMENTS

| | | | | |
|---|---|---|---|---|
| 7,537,310 | B2 * | 5/2009 | Konno et al. | 347/43 |
| 2004/0041882 | A1 * | 3/2004 | Konno et al. | 347/43 |

FOREIGN PATENT DOCUMENTS

| | | |
|---|---|---|
| EP | 1048471 | 11/2000 |
| JP | 2000-318189 | 11/2000 |
| JP | 2005-59214 | 3/2005 |

* cited by examiner

*Primary Examiner* — Huan Tran
(74) *Attorney, Agent, or Firm* — Canon USA Inc ID Division

(57) ABSTRACT

The present invention reduces image deterioration such as density nonuniformity when recording is performed using a recording head having two ejection orifice rows that eject a predetermined achromatic ink, for example, gray ink. For this purpose, the distance between two ejection orifice rows that eject a predetermined achromatic ink is larger than the distance between two ejection orifice rows that eject a predetermined chromatic ink.

10 Claims, 15 Drawing Sheets

INK JET RECORDING APPARATUS AND INK JET RECORDING HEAD

BACKGROUND OF THE INVENTION

1. Field of the Invention

The present invention relates to an ink jet recording head that ejects ink, and an ink jet recording apparatus that records an image using the ink jet recording head.

2. Description of the Related Art

A bidirectional recording method is known as one of recording methods in an ink jet recording apparatus. In a serial type recording apparatus, the recording head first performs scanning in a forward direction for recording, and then paper is fed by a predetermined amount. Next, recording scanning is also performed during backward movement of the recording head. This recording method achieves an approximately double recording speed or throughput compared to unidirectional recording in which recording is performed during forward scanning, whereas recording is not performed during backward return movement of the recording head.

The bidirectional recording method is effective means in improving the recording speed or the like as described above. However, it is known that color varies among scanning areas and this leads to color nonuniformity or color misregistration in the whole image. This is because the application order of respective colors of inks differs between the forward and backward directions of the bidirectional recording. In a recording apparatus, ejection orifice rows (nozzle rows) for respective colors of inks are commonly arranged in the scanning direction. However, the application order of inks is reversed between the forward scanning and the backward scanning depending on the arrangement of the ejection orifice rows.

When dots of a predetermined color are formed by applying (ejecting) a plurality of kinds of inks so that these inks overlap on a pixel, inks applied to the recording medium earlier develop their colors more strongly. This is because the inks applied to the recording medium earlier easily color the material in a layer closer to the surface of the recording medium, while the inks applied to the recording medium later less easily color the material in the surface of the recording medium and permeate deeper through the recording medium in its thickness direction before they are fixed. This phenomenon is significant when coated paper is used that has a silica layer as an ink receiving layer. However, this phenomenon also occurs on plane paper or a gloss recording medium that has a gloss layer formed in the surface thereof and an ink receiving layer formed in the inside thereof.

Japanese Patent Laid-Open No. 2000-318189 describes a configuration that eliminates color nonuniformity or the like attributed to the application order of inks. In this configuration, two nozzle rows are provided for each color of ink and arranged symmetrically with respect to an axis perpendicular to the scanning direction.

FIG. 1 shows the configuration of a color ink chip 1100 of a recording head in Japanese Patent Laid-Open No. 2000-318189. In the figure, a pair of nozzle rows c1 and c2 that eject cyan ink, a pair of nozzle rows m1 and m2 that eject magenta ink, and a pair of nozzle rows y1 and y2 that eject yellow ink are each arranged symmetrically with respect to an axis perpendicular to the scanning direction X. When recording is performed using this recording head by the bidirectional recording method, in order to form ink dots in each pixel, the inks are ejected (applied) in the order of c1, m1, y1, y2, m2, and c2 in the forward scanning. On the other hand, in the backward scanning, the inks are ejected in the order of c2, m2, y2, y1, m1, and c1. In this way, the inks can be applied or overlap one another in the same order between the forward scanning and the backward scanning. As a result, regardless of the scanning direction of the recording head, the inks can be applied in the same order, and therefore color nonuniformity attributed to bidirectional recording can be reduced.

On the other hand, black ink nozzle rows k1 and k2 are also provided in the chip 1100. The positional relationship between the nozzle rows k1 and k2 and the other ink nozzle rows is the order of k1, k2, c1, m1, y1, y2, m2, and c2. In this case, the order in which black ink and other inks overlap varies depending on the scanning direction. However, when dots of an image to be recorded are formed using only black ink, the above overlapping with other inks does not occur.

However, in reality, when a high density part is expressed, black ink is often used rather than using chromatic dye inks such as cyan, magenta, and yellow inks. This is because, compared to recording a black image in black (process black) expressed using cyan, magenta, and yellow dye inks, forming a black image using black ink uses a smaller amount of ink and therefore can prevent problems such as ink overflow. In addition, when black ink is used, the optical reflection density of the recorded black image is high, and high contrast recording can be achieved.

However, when a relatively low density part is expressed in black ink, the number of ink dots shot per unit area is small, and therefore the area on the recording material where ink is not shot is large, and the color of the recording paper can be seen. Many widely-used recording papers (recording media) are light in color, for example, white. Therefore, compared to cyan, magenta, and yellow inks, black ink has low lightness, and the difference in lightness from the recording medium is large. Therefore, the shape of each recorded ink droplet can be easily visually noticed. As a result, disadvantageously, the recorded image appears rough, and the smoothness decreases.

Therefore, hitherto, by using process black for recording a relatively low density part, less granular and smooth gradation expression has been achieved.

On the other hand, in a relatively high density part, black ink and color inks are superposed. However, process black ink and black ink are rarely superposed, and therefore color nonuniformity due to bidirectional recording-induced difference in the ink application order occurs rarely.

Recently, there has been known a recording apparatus that uses gray ink for the purpose of further improvement of image quality. According to this recording apparatus, the dot shape of gray ink, which is lighter than black ink, on a recording medium is less noticeable than that of black ink, and so granular impression can be reduced. Therefore, a recording apparatus that uses achromatic black and gray inks and chromatic cyan, magenta, and yellow inks uses gray ink and cyan, magenta, and yellow inks in a relatively low density part.

As described above, some ink jet recording apparatuses form dots by superposing gray ink, which is achromatic ink, and chromatic inks such as cyan, magenta, and yellow inks. In this case, depending on the order in which a nozzle row for gray ink and nozzle rows for other colors of inks are arranged in the sub-scanning direction, the order in which inks are applied or superposed varies and color nonuniformity can occur. To solve this problem, it is possible to provide two nozzle rows for gray ink as with other color inks and to dispose the two nozzle rows symmetrically with respect to an axis perpendicular to the scanning direction.

However, when two nozzle rows are provided for one color, the relative positional relationship between nozzle rows is liable to deviate from the ideal positional relationship. For example, attaching errors of nozzles can occur in the process of producing recording heads. Even if a recording head is free from manufacturing errors, the recording head can be obliquely mounted in a main body of a recording apparatus. In this case, landing positions of ink droplets ejected from nozzle rows onto a recording medium deviate from ideal positions, and change of color shade, streaks, density nonuniformity, and so forth occur in the recoded image. This leads to image deterioration.

SUMMARY OF THE INVENTION

The present invention reduces image deterioration such as density nonuniformity when recording is performed using a recording head having two ejection orifice rows that eject a predetermined achromatic ink, for example, gray ink.

In an aspect of the present invention, an ink jet recording apparatus includes a recording head that ejects two or more colors of achromatic inks and one or more colors of chromatic inks, and a scanning unit that makes the recording head scan a recording medium. The recording head has first and second ejection orifice rows that eject a predetermined achromatic ink and third and fourth ejection orifice rows that eject a predetermined chromatic ink. In the direction of scanning of the recording head, a distance between the first ejection orifice row and the second ejection orifice row is larger than a distance between the third ejection orifice row and the fourth ejection orifice row.

In another aspect of the present invention, an ink jet recording head ejects two or more colors of achromatic inks and one or more colors of chromatic inks. The recording head includes first and second ejection orifice rows that eject a predetermined achromatic ink, and third and fourth ejection orifice rows that eject a predetermined chromatic ink. In the direction of scanning of the recording head, a distance between the first ejection orifice row and the second ejection orifice row is larger than a distance between the third ejection orifice row and the fourth ejection orifice row.

According to the present invention, image deterioration such as density nonuniformity when recording is performed using a recording head having two ejection orifice rows that eject a predetermined achromatic ink, for example, gray ink, can be reduced.

Further features of the present invention will become apparent from the following description of exemplary embodiments with reference to the attached drawings.

DESCRIPTION OF THE EMBODIMENTS

Figure 1:
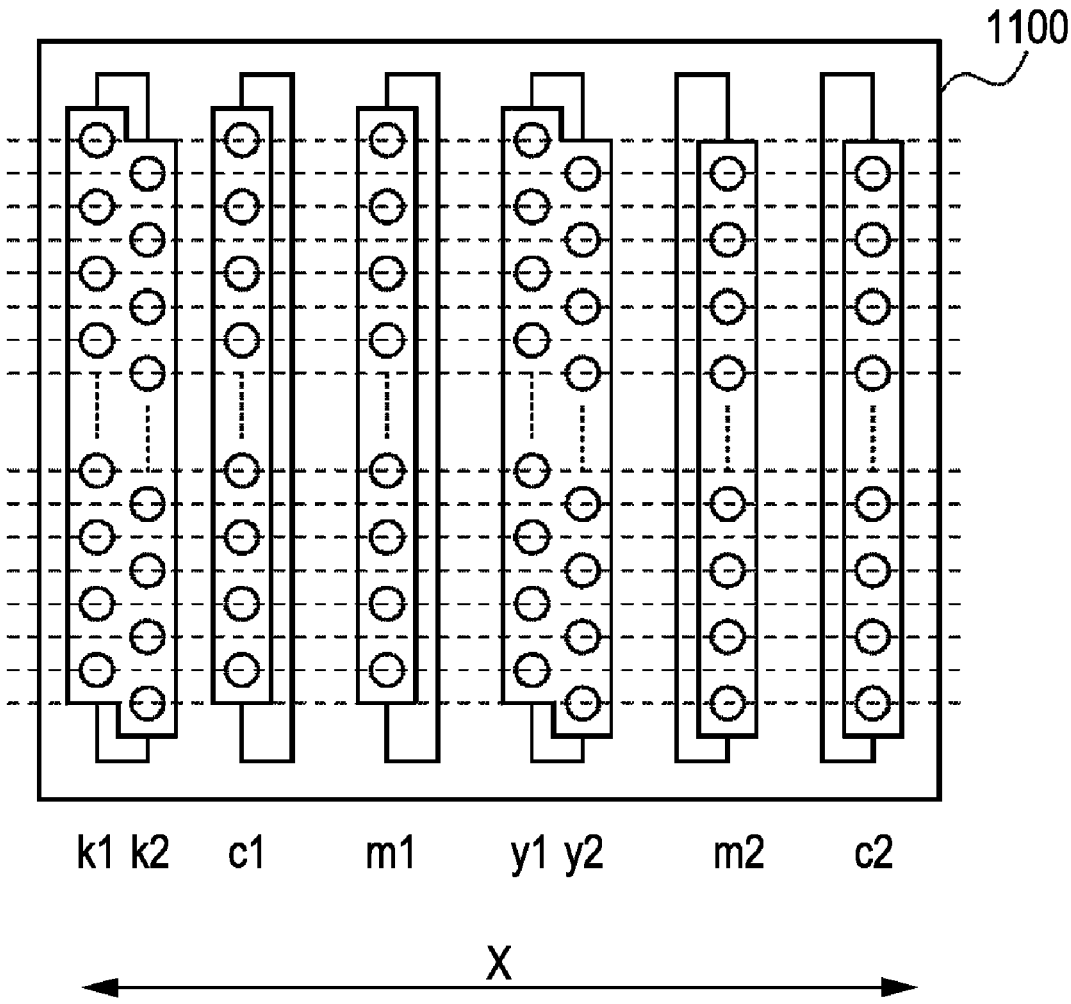
FIG. 1 PRIOR ART
FIG. 1 shows the arrangement of ejection orifice rows in a conventional recording head.

In this specification, the term "recording" is not limited to forming significant information such as characters and graphics but includes forming an image, a pattern, and so forth on a recording medium regardless of whether significant or insignificant, and processing a medium. Objects of recording need not necessarily be visible.

The term "recording medium" is not limited to paper, which is used in a common recording apparatus, but includes anything capable of receiving ink, for example, cloth, a plastic film, a metal plate, glass, ceramics, wood, and leather.

As with the above term "recording," the term "ink" is to be understood to have a broad meaning. It refers to liquid that is applied to a recording medium for forming an image, a pattern, and so forth, processing a recording medium, or processing ink. Processing ink includes, for example, solidifying or insolubilizing the color material in ink applied to a recording medium.

The term "recording element" (also referred to as "nozzle") includes, unless otherwise noted, an ejection orifice, a liquid path communicating therewith, and an element generating energy used for ink ejection.

For an ink jet recording apparatus according to an embodiment of the present invention, a detailed description will be given of inks used, the configuration of a recording head, the configuration of the recording apparatus, and so forth.

Inks

First, a description will be given of inks used in an ink jet recording apparatus (hereinafter simply referred to as recording apparatus or printer) according to an embodiment of the present invention.

In this embodiment, two kinds of black inks are used depending on the recording mode as described below. Of the two black inks, a first black ink includes a pigment of carbon black as the color material and will hereinafter be also referred to as "pigment black ink." The surface of the pigment is treated, for example, with a carboxyl group so that the pigment can be dispersed in the ink. It is preferable to add polyalcohol such as glycerin as a humidity retention agent to prevent the evaporation of moisture from the ink. The pigment ink is used to print characters, so it is important that edges of black ink dots formed on plain paper not be degraded. As long as the edges are not degraded, an acetylene glycol-based surfactant may be added to adjust the penetration of the ink. In addition, a polymer may be added as a binder to increase the binding force between the pigment and a recording medium.

On the other hand, a second black ink includes a black dye as the color material and will hereinafter be also referred to as "dye black ink." To achieve sufficiently quick penetration of ink in the surface of a recording medium, an acetylene glycol-based surfactant is added at a concentration at or above the critical micelle concentration. Also for the dye black ink, it is preferable to add polyalcohol such as glycerin as a humidity retention agent to prevent the evaporation of moisture from the ink. In addition, for example, urea may be added to increase the solubility of the color material.

In this embodiment, cyan ink, magenta ink, and yellow ink are used as chromatic inks, and gray ink is used as an achromatic ink. It is preferable that these be dye inks to which are added the same humidity retention agent, surfactant, and additive as those added to the dye black ink. The surfactant is desirably adjusted so that the dye black ink, the cyan ink, the magenta ink, the yellow ink, and the gray ink have approximately the same surface tension. By giving the inks the same penetration ability in plain paper, it is possible to prevent bleeding between areas on paper recorded with different inks. In other characteristics such as penetration ability and viscosity, the dye black ink, the cyan ink, the magenta ink, the yellow ink, and the gray ink are adjusted to be the same.

Configuration of Recording Head

The configuration of a recording head 3 of this embodiment will be described with reference to FIGS. 2 and 3.

Figure 2:
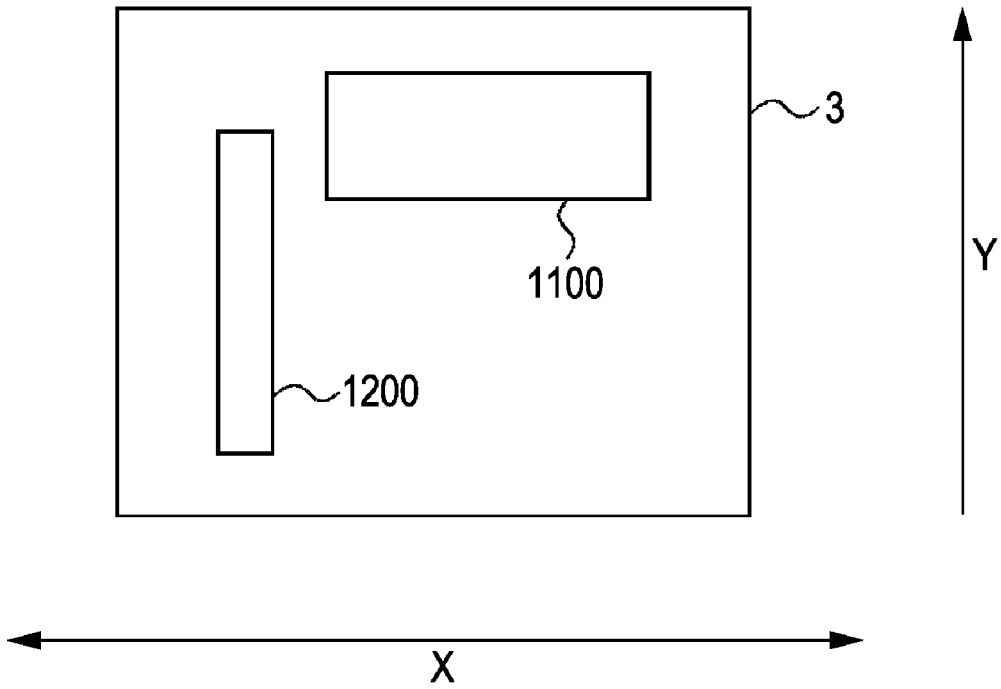
FIG. 2 schematically illustrates the chip configuration of a recording head used in an embodiment of the present invention.

FIG. 2 shows a recording head mounted in the recording apparatus as viewed from a recording medium, and it schematically shows the arrangement of recording chips. As shown in the figure, the recording head of this embodiment has a color ink chip 1100 and a black ink chip 1200. The black ink chip 1200 has ejection orifices for ejecting the pigment black ink. This chip is longer than the color ink chip 1100 in the recording medium conveying direction (sub-scanning direction) Y and is offset from each ejection orifice row of the color ink chip 1100 in the sub-scanning direction. As shown in FIG. 2, in the conveying direction Y, the downstream end of each ejection orifice row in the color ink chip 1100 is located downstream of the downstream end of each ejection orifice row in the black ink chip 1200. This is because emphasis is placed on the recording speed when, for example, a document is recorded using the black ink chip. The area on which the black ink chip 1200 can perform recording in one scan is wider in the sub-scanning direction than the area on which the color ink chip 1100 can perform recording in one scan. In addition, the black ink chip 1200 is offset from the color ink chip 1100 in the sub-scanning direction so that a recording area on a recording medium can undergo recording in pigment black ink before undergoing application of color inks. This configuration creates a time difference between the recording by ejecting pigment black ink from the black ink chip 1200 and the recording by the color ink chip 1100. As a result, bleeding of ink between an image recorded in pigment black ink and an image recorded in dye color inks is reduced.

Figure 3:
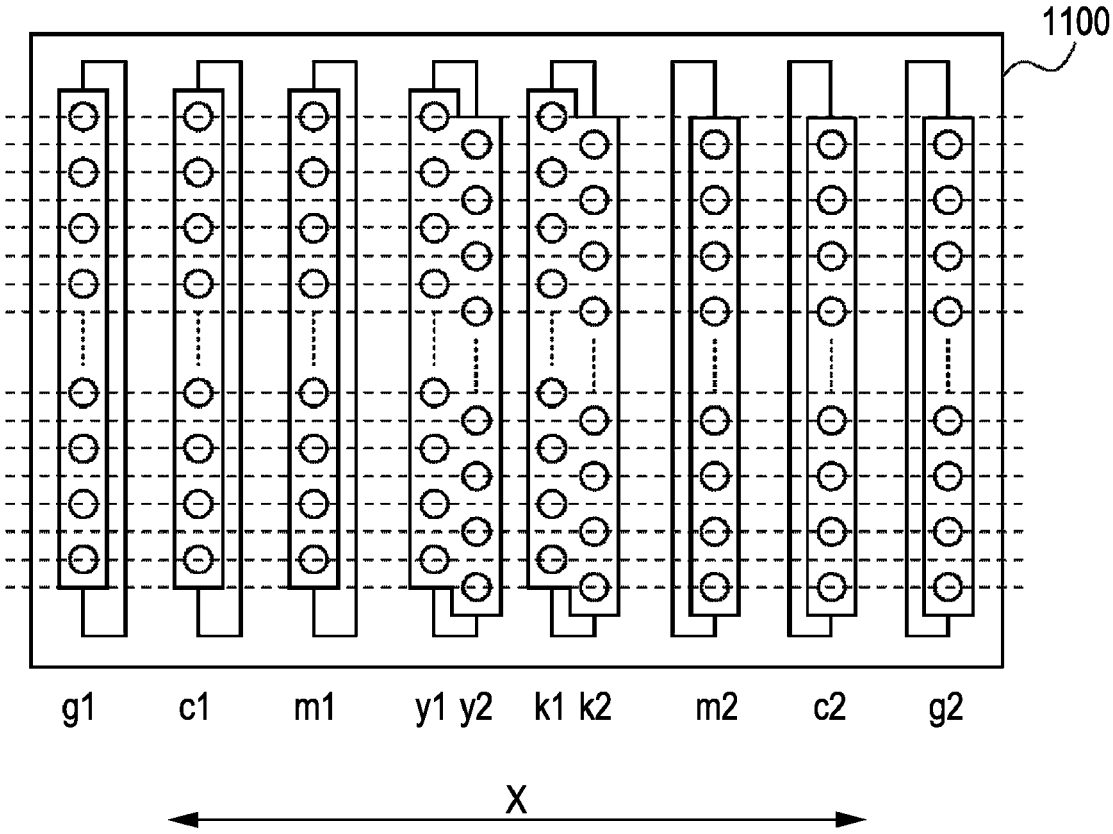
FIG. 3 shows the arrangement of ejection orifice rows in a color ink chip of a recording head used in an embodiment of the present invention.

FIG. 3 is a schematic view showing the arrangement of the ejection orifices rows for color inks in the color ink chip 1100. The color ink recording chip 1100 of this embodiment has cyan ejection orifice rows c1 and c2, magenta ejection orifice rows m1 and m2, yellow ejection orifice rows y1 and y2, gray ejection orifice rows g1 and g2, and dye black ink ejection orifice rows k1 and k2. Each ejection orifice in each ejection orifice row is provided, for example, with a heater that generate thermal energy used for ejecting ink. Two ejection orifice rows are provided for each color of ink. The two ejection orifice rows for each of cyan, magenta and gray inks are arranged symmetrically with respect to the same axis of symmetry.

In each ejection orifice row, ejection orifices are arranged at an approximately equal pitch. The two ejection orifice rows for the same color ink are offset from each other in the sub-scanning direction by half the pitch of ejection orifices. The purpose of this arrangement is to maximize the efficiency of covering a recording medium with recording dots in one recording scan.

Application Order of Inks

In this embodiment, the combination of cyan, magenta, and gray inks is referred to as a first combination, and the combination of cyan, magenta, gray, yellow, and dye black inks is referred to as a second combination. When a secondary or tertiary color is expressed using any two or more kinds of inks in the first combination, there are two ink application orders.

Figure 4:
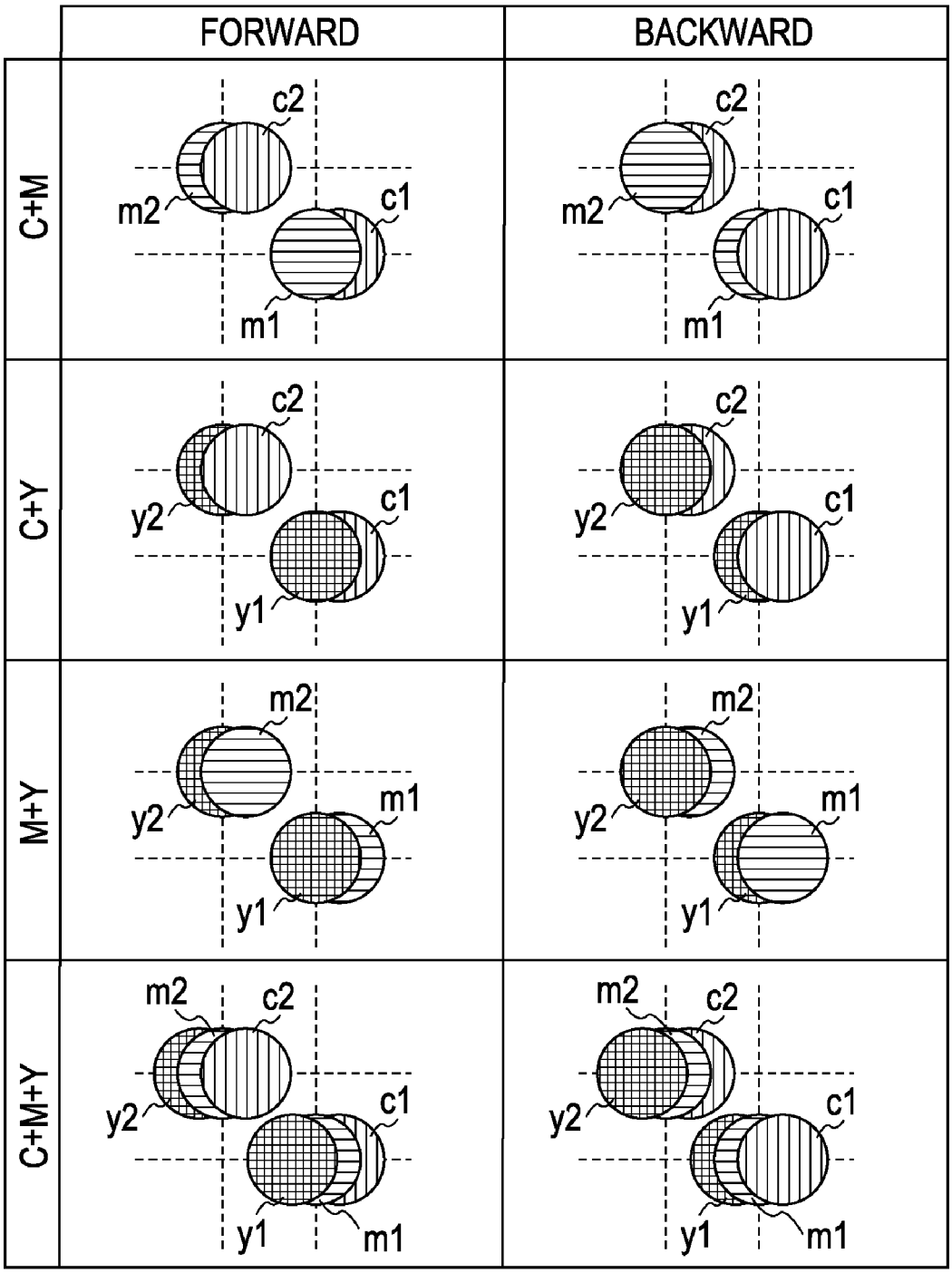
FIG. 4 illustrates the relationship between the application order of a plurality of inks and the scanning direction of a recording head.

With reference to FIG. 4, the application order in the first combination will be described more specifically. In FIG. 4, the vertically hatched circles represent cyan dots (dots formed of cyan ink; this applies to the other kinds of dots), the horizontally hatched circles represent magenta dots, and the cross-hatched circles represent yellow dots. In this figure, the dots are shifted so that the actual order of overlapping can be seen.

As is apparent from the figure, for blue (C+M), which is a secondary color obtained by combining cyan ink and magenta ink, two kinds of pixels: pixels in which cyan and magenta inks are applied in this order, and pixels in which magenta and cyan inks are applied in this order, can be recorded during each of the forward and backward scanning, respectively, using the set of the nozzle rows c1 and m1 and the set of the nozzle rows c2 and m2. Such processing will hereinafter be referred to as distribution processing. By processing the recording data, almost the same number of the two kinds of pixels can be generated during the forward and backward scanning. Such distribution processing can be performed in both one-pass recording and multi-pass recording described below.

As described above, in this embodiment, recording data is processed so that almost the same number of two kinds of pixels with different ink application orders or dot overlapping orders are generated during the forward and backward scanning, thereby making the color nonuniformity attributed to different ink application orders less noticeable.

Likewise, for green (C+Y), which is a secondary color obtained by combining cyan ink and yellow ink, two kinds of pixels: pixels in which cyan and yellow inks are applied in this order, and pixels in which yellow and cyan inks are applied in this order, can be generated using the set of the nozzle rows c1 and y1 and the set of the nozzle rows c2 and y2. For red (M+Y), which is a secondary color obtained by combining magenta ink and yellow ink, two kinds of pixels: pixels in which magenta and yellow inks are applied in this order, and pixels in which yellow and magenta inks are applied in this order, can be generated using the set of the nozzle rows m1 and y1 and the set of the nozzle rows m2 and y2. Furthermore, for a tertiary color obtained using cyan, magenta, and yellow inks, two kinds of pixels: pixels in which cyan, magenta, and yellow inks are applied in this order; and pixels in which yellow, magenta, and cyan inks are applied in this order, can be generated using the set the nozzle rows c1, m1, and y1 and the set of nozzle rows c2, m2, and y2.

For dye black ink and cyan ink, and dye black ink and magenta ink, dots can also be superposed in two orders. However, for dye black ink and yellow ink, since the nozzle row arrangement is not symmetrical, the two application orders are different from those shown in FIG. 4.

Configuration of Recording Apparatus

Figure 5:
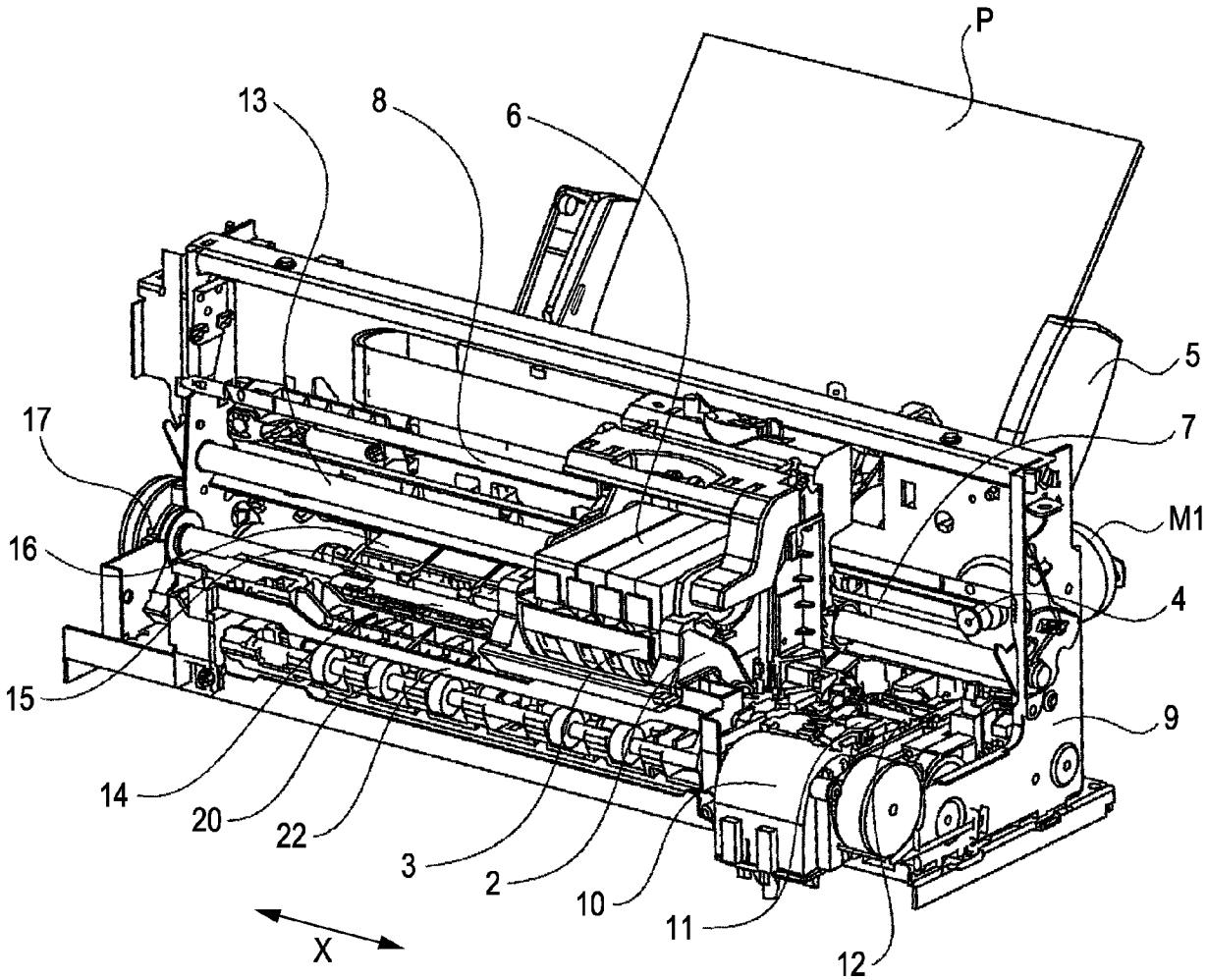
FIG. 5 is a perspective view showing the configuration of an ink jet recording apparatus according to an embodiment of the present invention.

FIG. 5 is a perspective view showing the apparatus configuration of the recording apparatus of this embodiment with the case cover removed.

As shown in the figure, the recording apparatus of this embodiment has a carriage 2 on which the recording head 3 described in FIG. 2 is detachably mounted, and a drive mechanism for moving the carriage 2 and making the recording head 3 perform scanning. Specifically, the drive force of a carriage motor M1 serving as a drive source is transmitted to the carriage 2 through a transmission mechanism 4 including a belt and pulleys, thereby reciprocating the carriage 2 in the direction of arrow X in FIG. 5. On the carriage 2 are detachably mounted ink cartridges 6 corresponding to the kinds of inks used in this recording apparatus. As described in FIGS. 2 and 3, this embodiment uses six kinds of inks: first and second black, cyan, magenta, yellow, and gray inks. However, FIG. 5 is simplified and shows only four ink cartridges.

The carriage 2 has ink supply paths formed therein so that the black ink chip 1200 and the color ink chip 1100 shown in FIGS. 2 and 3 are supplied with corresponding inks from the cartridges. The carriage 2 and the recording head 3 including the above chips are appropriately joined at a surface so as to effect a suitable electrical connection. In response to a recording signal, a voltage pulse is applied to the above heaters to create a bubble in ink. The pressure of the bubble can eject ink from the ejection orifices. More specifically, a pulse is applied to the heaters serving as electric thermal conversion members, and the heaters thereby generate thermal energy. This thermal energy causes film boiling of ink to create a bubble. Using the pressure change caused by the expansion and contraction of the bubble, ink is ejected from the ejection orifices.

In addition, the recording apparatus has a paper feed mechanism 5 that conveys (feeds) recording paper P serving as a recording medium. The paper feed mechanism 5 feeds paper by a predetermined length in conjunction with the scanning of the recording head. The recording apparatus further has a recovery unit 10 at one end of the moving area of the carriage 2. The recovery unit 10 performs ejection recovery processing of the recording head 3.

In such an ink jet recording apparatus, recording paper P is fed by a paper feed mechanism 5 into the scanning area of the recording head 3, and the recording head 3 performs scanning, thereby recording an image and/or characters on the recording paper P.

The above-described apparatus configuration will be described more specifically. The carriage 2 is connected to part of a drive belt 7 constituting the transmission mechanism 4 that transmits the drive force of the carriage motor M1. In addition, the carriage 2 is guided and supported slidably along a guide shaft 13 in the direction of arrow X. Thus, the drive force of the carriage motor M1 is transmitted to the carriage 2 and can move the carriage 2. In this case, the carriage 2 can be moved forward and backward by rotating the carriage motor M1 forward and reversely, respectively. In FIG. 5, reference numeral 8 denotes a scale for detecting the position of the carriage 2 in the direction of arrow X. In this embodiment, the scale 8 is a transparent PET film on which black bars are printed at a predetermined pitch. One end of the scale 8 is fixed to a chassis 9, and the other end is supported by a leaf spring (not shown). A sensor provided in the carriage 2 optically detects the bars of the scale 8, thereby detecting the position of the carriage 2.

A platen (not shown) is provided in an area facing the ejection orifice rows in the scanning area of the recording head 3. By ejecting inks onto recording paper P conveyed on the platen, recording is performed on the recording paper maintained flat by the platen.

Reference numeral 14 denotes a conveying roller that is driven by a conveying motor M2 (not shown). Reference numeral 15 denotes a pinch roller that brings a recording sheet into contact with the conveying roller 14 using a spring (not shown). Reference numeral 16 denotes a pinch roller holder that rotatably supports the pinch roller 15. Reference numeral 17 denotes a conveying roller gear that is attached to one end of the conveying roller 14. The rotation of the conveying motor M2 transmitted to the conveying roller gear 17 through an intermediate gear (not shown) drives the conveying roller 14. Reference numeral 20 denotes an ejection roller for ejecting recording paper on which an image is formed by the recording head 3 out of the apparatus. The ejection roller 20 is also driven by the rotation of the conveying motor M2 transmitted thereto. By the pressing force of a spring (not shown), a spur roller (not shown) is pressed against the ejection roller 20 with recording paper therebetween. Reference numeral 22 denotes a spur holder that rotatably supports the spur roller.

As described above, a recovery unit 10 for maintaining ejection performance of the recording head 3 is disposed at a predetermined position (for example, a position corresponding to the home position) outside the area in which the carriage 2 reciprocates for recording operation (scanning area). The recovery unit 10 has a capping mechanism 11 and a wiping mechanism 12. The capping mechanism 11 caps an ejection orifice surface (a surface in which ejection orifice rows of each color are provided) of the print head 3. The wiping mechanism 12 cleans the ejection orifice surface of the print head 3. In conjunction with the capping of the ejection orifice surface with the capping mechanism 11, a not shown suction mechanism (for example, a suction pump) in the recovery unit 10 forces ink out of the ejection orifices, thereby performing ejection recovery processing such as removing thickened ink and bubbles from ink paths of the recording head 3. By capping the ejection orifice surface of the recording head 3, for example, when recording is not performed, the recording head 3 can be protected, and drying of ink can be prevented. In addition, the wiping mechanism 12 is disposed near the capping mechanism 11 and wipes ink droplets off the ejection orifice surface of the recording head 3, thereby cleaning it. By the capping mechanism 11 and the wiping mechanism 12, the recording head 3 can be maintained in normal ejection condition.

Figure 6:
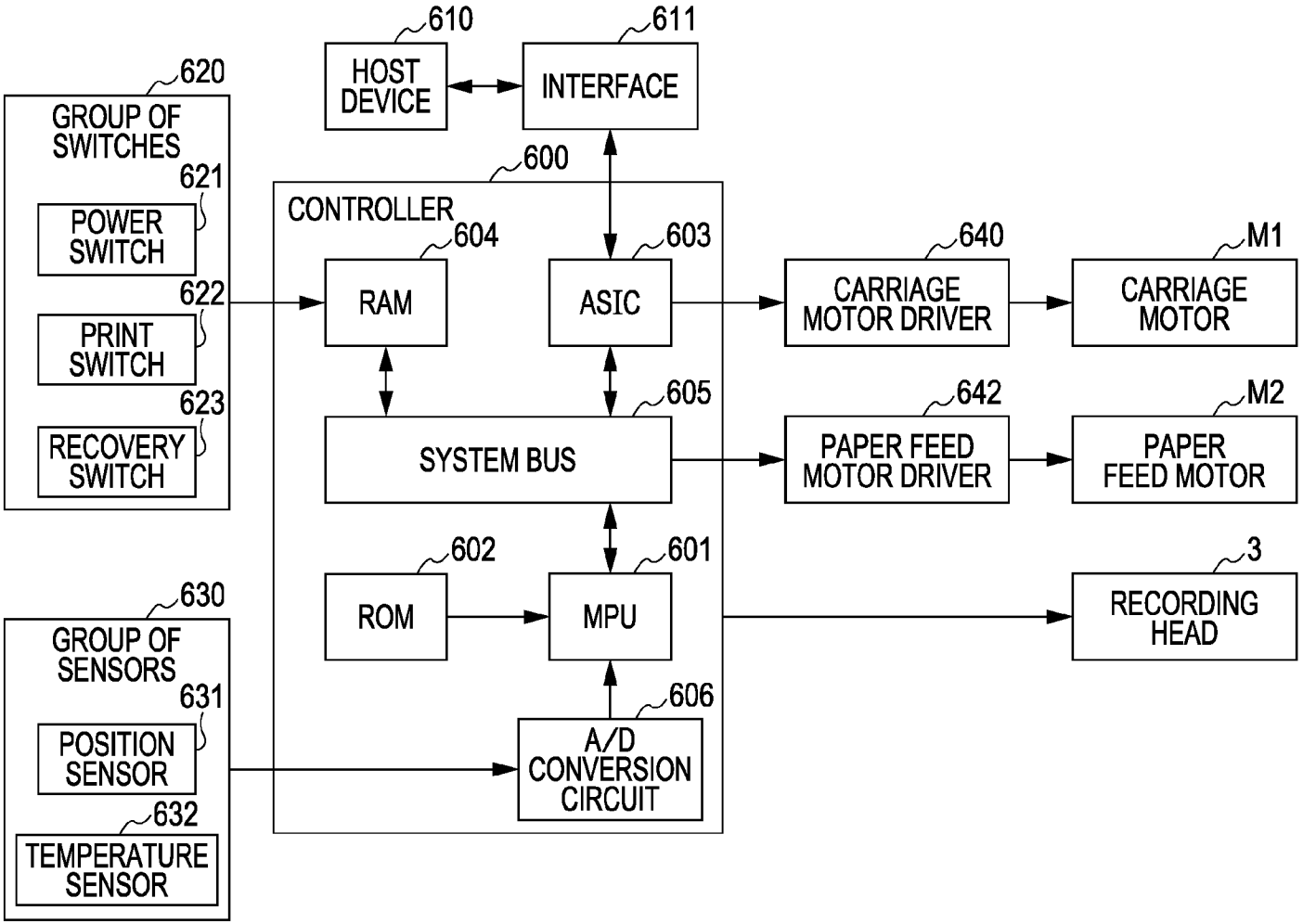
FIG. 6 is a block diagram showing a schematic configuration of a control system of the ink jet recording apparatus shown in FIG. 5.

FIG. 6 is a block diagram showing a schematic configuration of a control system of an ink jet recording apparatus having the apparatus configuration shown in FIG. 5.

As shown in FIG. 6, the controller 600 includes an MPU 601, a ROM 602, and an application specific integrated circuit (ASIC) 603. The ROM 602 stores programs to execute various recording modes described below and to control recording operation in the recording modes, required tables, and other fixed data. The ASIC 603 generates control signals for controlling the carriage motor M1, the conveying motor M2, and the recording head 3. In addition, the controller 600 includes a RAM 604, a system bus 605, and an A/D converter 606. The RAM 604 has an area for developing image data and a work area for executing programs. The system bus 605 connects the MPU 601, the ASIC 603, and the RAM 604 to each other and allows them to exchange data. The A/D converter 606 A/D converts an analog signal input from a sensor group described below and supplies the resulting digital signal to the MPU 601.

Reference numeral 610 denotes a host computer (or a reader for reading images or a digital camera) serving as a supply source of images. The host computer 610 sends and receives image data, commands, status signals, and so forth to and from the controller 600 through an interface (I/F) 611.

Reference numeral 620 denotes a switch group. The switch group 620 includes switches with which an operator inputs instructions, for example, a power switch 621, a switch 622 for instructing the start of print, and a recovery switch 623 for instructing the start of recovery processing of the recording head 3. Reference numeral 630 denotes a sensor group, which includes a photo coupler 631 and a temperature sensor 632. The photo coupler 631, combined with the above scale 8, detects that the recording head 3 is located at the home position. The temperature sensor 632 is provided for detecting the environmental temperature at a suitable place in the recording apparatus. Reference numeral 640 denotes a driver that drives the carriage motor M1. Reference numeral 642 denotes a driver that drives the paper feed motor M2.

In the above configuration, the recording apparatus of the present invention analyzes the command of recording data transferred through the interface 611 and develops image data to be recorded in the RAM 602.

The area (expansion buffer) into which the image data is expanded has a horizontal size of the number Hp of pixels corresponding to a recordable area in the main scanning direction and a vertical size of 64n (n is an integer), the number of pixels in the vertical direction that are recorded in one scan using the nozzle rows in the recording head. The expansion buffer is provided in a storage area of the RAM 602. A storage area (print buffer) on the RAM 602 that is referenced in order to send data to the recording head during recording scanning has a horizontal size of the number Vp of pixels corresponding to the recordable area in the main scanning direction and a vertical size of 64n, the number of pixels in the vertical direction that are recorded in one recording scan of the recording head.

When the recording head performs recording scanning, the ASIC 603 acquires data on the driving of the heater for each ejection orifice in the recording head while directly accessing the storage area (print buffer) of the RAM 602. The ASIC 603 transfers the data acquired to (the driver for) the recording head 3.

Data Processing

In this embodiment, multi-valued data of red (R), green (G), and blue (B) is subjected to predetermined image processing and thereby converted into quantized data of cyan, magenta, yellow, gray, and black corresponding to the ink colors used in the present printer. Although this processing is performed by the host device 610 in this embodiment, it may be performed by a controller of the printing apparatus.

The data processing of this embodiment is executed depending on the recording mode described below. Specifically, data is converted into two-valued data or three-valued data depending on the print mode. In a recording mode for high-speed recording, data is converted into two-valued data. In a recording mode for high image quality, data is converted into three-valued data. In this data processing and recording operation, a pixel has such a size that two ejection orifices ejecting the same color of ink and adjacent in the sub-scanning direction at half the distance of the ejection orifice arrangement pitch in each ejection orifice row (see FIG. 3) can form their respective dots. In this pixel, these dots are formed at separate positions. More specifically, one pixel is an area having dots formed at two grid points shown in FIG. 4.

For bidirectional recording, the data processing distributes data to the two ejection orifice rows for each color of ink. Specifically, a print buffer (first print buffer or second print buffer) is provided for each ejection orifice row, and the two-valued data or three-valued data is stored in the corresponding print buffer. In each scanning, data is read out from the print buffer corresponding to each ejection orifice row, and data transfer is performed to eject ink from the ejection orifices in each ejection orifice row.

Two-Valued Data

When the quantized data of cyan, magenta, yellow, and gray are two-valued data, the same print buffer is used by a pair of nozzle rows for the same color of ink.

Specifically, a cyan first print buffer is assigned to the cyan nozzle rows c1 and c2, a magenta first print buffer is assigned to the magenta nozzle rows m1 and m2, a gray first print buffer is assigned to the gray nozzle rows g1 and g2, and a yellow first print buffer is assigned to the yellow nozzle rows y1 and y2. For, for example, the cyan nozzle rows, during the forward scanning, the two-valued data expanded in the cyan first print buffer is referenced and transferred to ejection orifices in both the cyan nozzle row c1 and cyan nozzle row c2 in the recording head, and ink is ejected from the corresponding ejection orifices. Similarly, during the backward scanning, the two-valued data expanded in the cyan first print buffer is referenced and transferred to ejection orifices in the cyan nozzle rows c1 and cyan nozzle rows c2, and ink is ejected from the corresponding ejection orifices. In this way, the same image is recorded by the cyan nozzle rows c1 and c2 on a recording medium. In a pixel of "1" meaning dot formation, two dots are formed using the ink ejected from different ejection orifice rows for the same color of ink. Similarly, for magenta, gray, and yellow, the magenta first print buffer, the gray first print buffer, and the yellow first print buffer, respectively, are referenced to record an image using two ejection orifice rows.

In this case, the two dots constituting each pixel are applied from different nozzle rows. Accordingly, as shown in FIG. 4, there are also two kinds of ink application orders for secondary and tertiary colors. Therefore, the entire recorded image has the same number of two kinds of pixels (combinations of dots) formed in two different application orders.

As described below, pigment ink is used depending on the recording mode. The two-valued data thereof is stored in one print buffer as in the normal recording. In a recording operation, the data is transferred to each ejection orifice in the black ink chip 1200 of the recording head. The same applies to three-valued data described below.

Three-Valued data

When quantized data of cyan, magenta, gray, and yellow are three-valued data, no dots, one dot, or two dots are formed in each pixel. Correspondingly, the content of the three-valued data is 0, 1, or 2. In the case of "0," no dots. In the case of "1," one dot. In the case of "2," two dots.

When quantized data of each color is three-valued data, for management of data, the storage area is divided into a first print buffer and a second print buffer corresponding to respective ejection orifice rows. Specifically, a cyan first print buffer is assigned to the cyan nozzle row c1. A magenta first print buffer is assigned to the magenta nozzle row m1. A gray first print buffer is assigned to the gray nozzle row g1. A yellow first print buffer is assigned to the yellow nozzle row y1. A yellow second print buffer is assigned to the yellow nozzle row y2. A magenta second print buffer is assigned to the magenta nozzle row m2. A cyan second print buffer is assigned to the cyan nozzle row c2. A gray second print buffer is assigned to the gray nozzle row g2.

If the quantized three-valued data is "0," non-ejection data "0" meaning "no data" is expanded in both the first and second print buffers. If the quantized three-valued data is "2,"

ejection data "1" meaning one dot data is expanded in both the first and second print buffers. Thus, if three-valued data for a color of ink is "2," two dots are formed by different nozzle rows in each pixel having three-valued data of "2" during each of the forward and backward scanning.

If the quantized three-valued data is "1," ejection data "1" is expanded in one of the first and second print buffers, and non-ejection data "0" is expanded in the other. In this case, every time three-valued data is "1" for the same color of ink, it is stored in which print buffer ejection data "1" is expanded. Next time three-valued data is "1," data expansion is controlled so that the data is expanded in the other print buffer. Thus, during each of the forward and backward scanning, one dot is formed in a pixel having three-valued data of "1" by one of two different nozzle rows.

As a result of the above distribution of three-valued data, when a large number of pixels are viewed macroscopically, the number of dots recorded by one of two different nozzle rows is the same as the number of dots recorded by the other.

The data processing in the case where the quantized data is two-valued is suitable for the high-speed recording mode because the volume of data to be processed is smaller compared to the data processing in the case where the quantized data is three-valued. In the case of two-valued data processing, since two dots are formed in each pixel in this embodiment, the resultant image is inferior in graininess to one obtained through the three-valued processing, which uses one dot in a low density part of an image to be recorded. Accordingly, three-valued data is used in the high quality recording mode. It is possible to perform two-valued quantization for yellow, which is less deteriorated in graininess, and to use three-valued quantization for the other colors.

When four or more-valued gradation expression is performed, print buffers are assigned to the nozzle rows in the same manner as the three-valued data distribution. As in the case of three-valued data, in the case of expression using an even number of dots (in the case of even number-valued data), the data is expanded so that the same number of dots are recorded in each of the first and second print buffers. In the case of expression using an odd number of dots (in the case of odd number-valued data), the data is expanded so that the number of dots in one of the first and second print buffers is one dot larger than that in the other print buffer. It is stored in which print buffer one-dot-larger data is expanded. Next time the number of dots for a pixel is odd, one-dot-larger data is expanded in the other print buffer.

In the case of dye black ink (second black ink), as shown in FIG. 3, the two ejection orifice rows therefor, unlike the ejection orifice rows for cyan and magenta inks, are not symmetrically arranged. However, the distribution of black print buffers and quantized data can be performed in the same manner as in the case of cyan, magenta, gray, and yellow inks.

Specifically, when the quantized data is two-valued, the two nozzle rows share one and the same print buffer. When the quantized data is three-valued, for management of data, the storage area is divided into a first print buffer and a second print buffer corresponding to respective ejection orifice rows. Specifically, for management, a black first print buffer is assigned to the black nozzle row k1, whereas a black second print buffer is assigned to the black nozzle row k2. In addition, the three-valued data is distributed in the same manner as in the case of cyan, magenta, and yellow inks.

However, since the ejection orifice rows k1 and k2 for the second black ink are not symmetrically arranged, unlike the case of cyan, magenta, and yellow inks, the order of application or overlapping of the second black ink and the other color inks varies between the forward scanning and the backward scanning. Further, the number of dot combinations formed in one of the two application orders cannot be the same as the number of dot combinations formed in the other application order.

One-Pass Recording

In this embodiment, one-pass or multi-pass bidirectional recording is performed depending on the recording mode. Multi-pass recording refers to a recording method in which a recording head performs multiple scanning in a predetermined area on a recording medium, thereby completing an image in the predetermined area.

Figure 7:
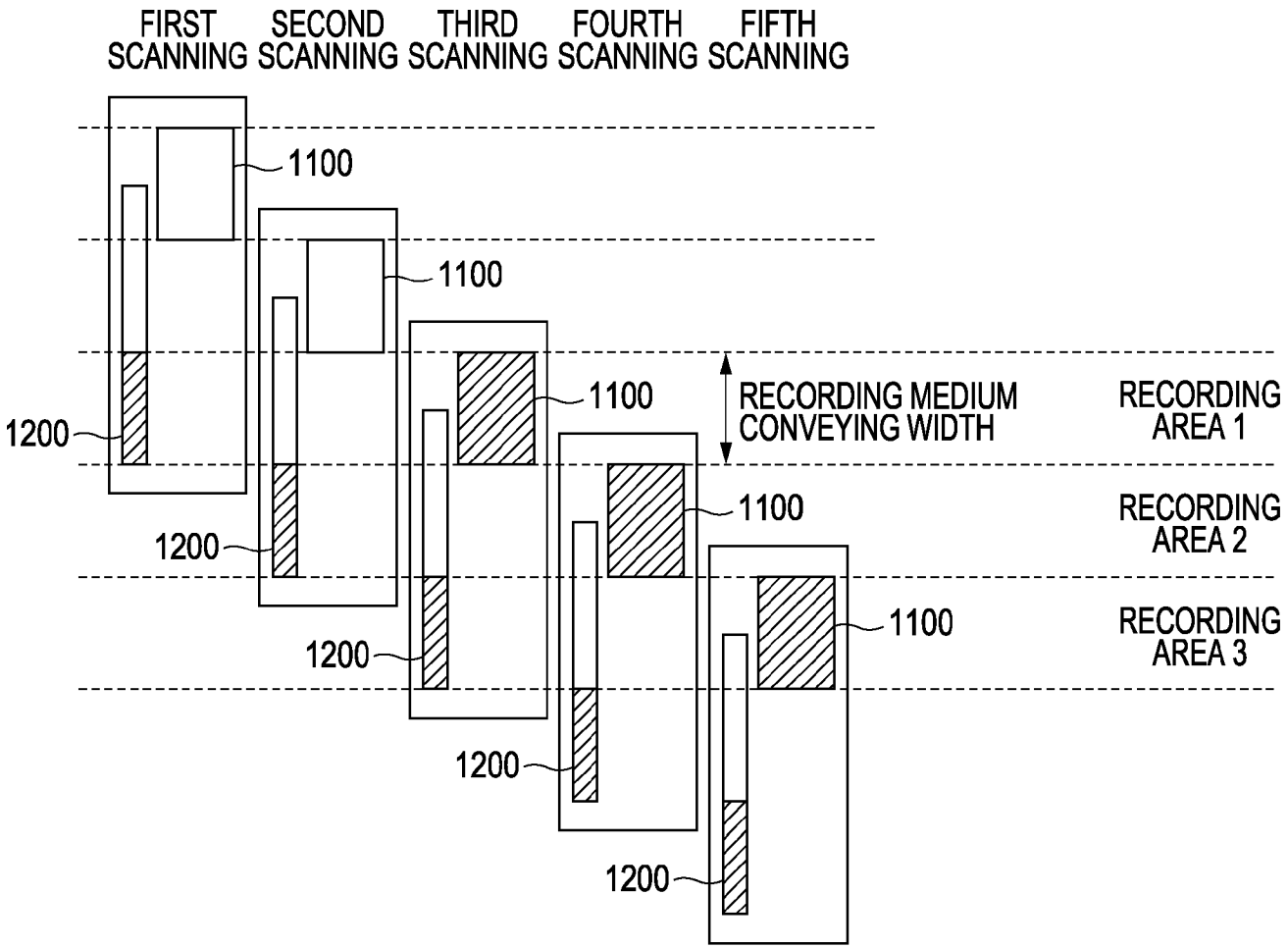
FIG. 7 illustrates one-pass recording of this embodiment.

First, one-pass recording of this embodiment will be described. The one-pass recording of this embodiment is such a recording method that recording of an image in a predetermined area by each chip is completed in a single scan. FIG. 7 schematically illustrates one-pass recording in which recording of an image in a predetermined area is completed in a single scan of a recording head.

In the figure, reference numeral 1100 denotes a color ink chip. Reference numeral 1200 denotes a black ink chip for the pigment black. The width of each chip corresponds to the width of its ejection orifice rows, or the width that can be recorded by scanning. The shaded part in each chip shows an ejection orifice portion used for recording in each scanning. Dashed lines in the figure show the distance by which a recording medium is conveyed in one sub-scan (paper feed). Specifically, the distance of conveyance in one sub-scan in this embodiment is equal to 64n pixels, which corresponds to the width of each ejection orifice row in the color ink chip. In the figure, the recording head performs scanning in the horizontal direction, and a recording medium is conveyed upward.

The one-pass recording in this embodiment has two modes: a mode in which both the black ink chip 1200 and color ink chip 1100 are used, and a mode in which only the color ink chip 1100 is used. The mode in which both chips are used will hereinafter be described. The same recording operation is also performed in the mode in which only the color ink chip 1100 is used.

First, in the first scanning (scanning in the forward direction X1), recording is performed in a recording area 1 using the pigment black ink chip 1200. Next, the recording medium is conveyed by a distance corresponding to 64n pixels, and in the second scanning (scanning in the backward direction X2), recording is performed in a recording area 2 using the pigment black ink chip 1200.

Next, the recording medium is conveyed by 64n pixels, and in the third scanning (scanning in the forward direction X1), recording is performed in a recording area 3 using the pigment black ink chip 1200. At the same time, recording is performed in the recording area 1 using the color ink chip 1100.

In the subsequent forward and backward scanning, between which a 64n pixel conveyance is interposed, recording is performed in two recording areas using the respective chips. Thus, an image is completed.

In this recording operation, the recording using pigment black ink can always be performed one scanning earlier than the recording using color inks in the same recording area. This reduces bleeding between the pigment black ink and the color inks.

Multi-Pass Recording

In this embodiment, data for each of a plurality of scanning in multi-pass recording is generated using a random mask, and then recording is controlled on the basis of the data generated. A random mask and recording control based on the data generated using the mask will hereinafter be described.

This multi-pass recording mode is a mode in which pigment black ink or dye black ink is used in addition to cyan, magenta, gray, and yellow inks.

Making of Random Mask

Figure 8:
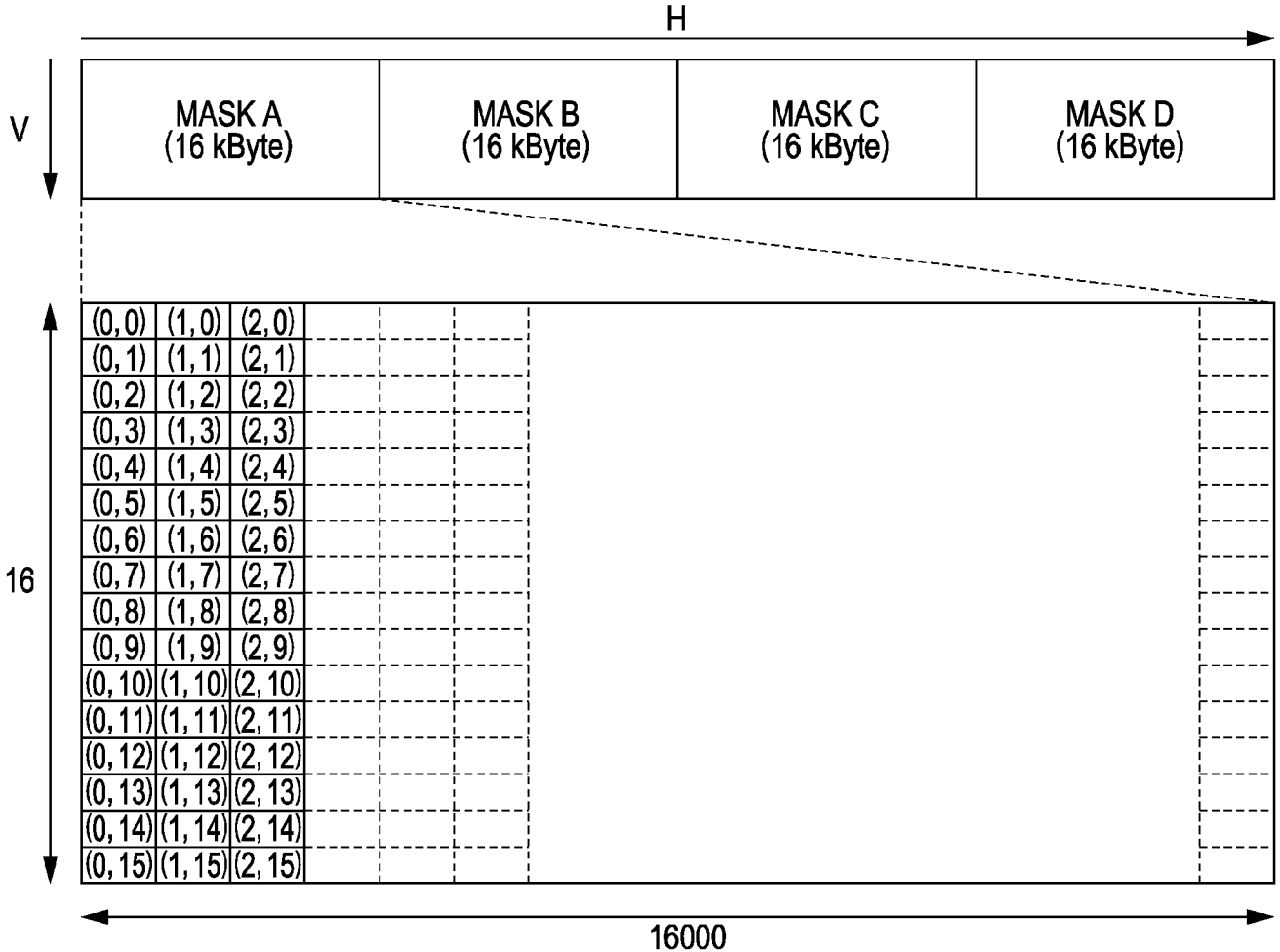
FIG. 8 illustrates a mask used for multi-pass recording.

FIG. 8 is a diagram schematically showing the configuration of a mask for four multi-pass recording (four pass) in which an image is completed by scanning the same recording area four times.

A mask for four pass is composed of four areas: a mask A, a mask B, a mask C, and a mask D. The mask A, mask B, mask C, and mask D are each composed of 16 kilobytes (1 kilobyte is 16,000 bits). Specifically, as shown in the figure, each mask is 16 bits long and 16,000 bits wide. The relationship between the vertical and horizontal sizes of the rectangular array of bits corresponds to the relationship between the vertical and horizontal sizes of the rectangular array of pixels constituting quantized image data. The position of a pixel in each mask is managed by defining the vertical direction as V and the horizontal direction as H as shown by arrows in the figure. By successively expanding the mask A, mask B, mask C and mask D in a storage area, each mask can be managed using H in the horizontal direction. According to this manner of management, the first bit of the mask A is (H, V)=(0, 0), the first bit of the mask B is (H, V)=(16,000, 0), the first bit of the mask C is (H, V)=(16,000×2, 0), and the first bit of the mask D is (H, V)=(16,000×3, 0).

Figures 9, 9A:
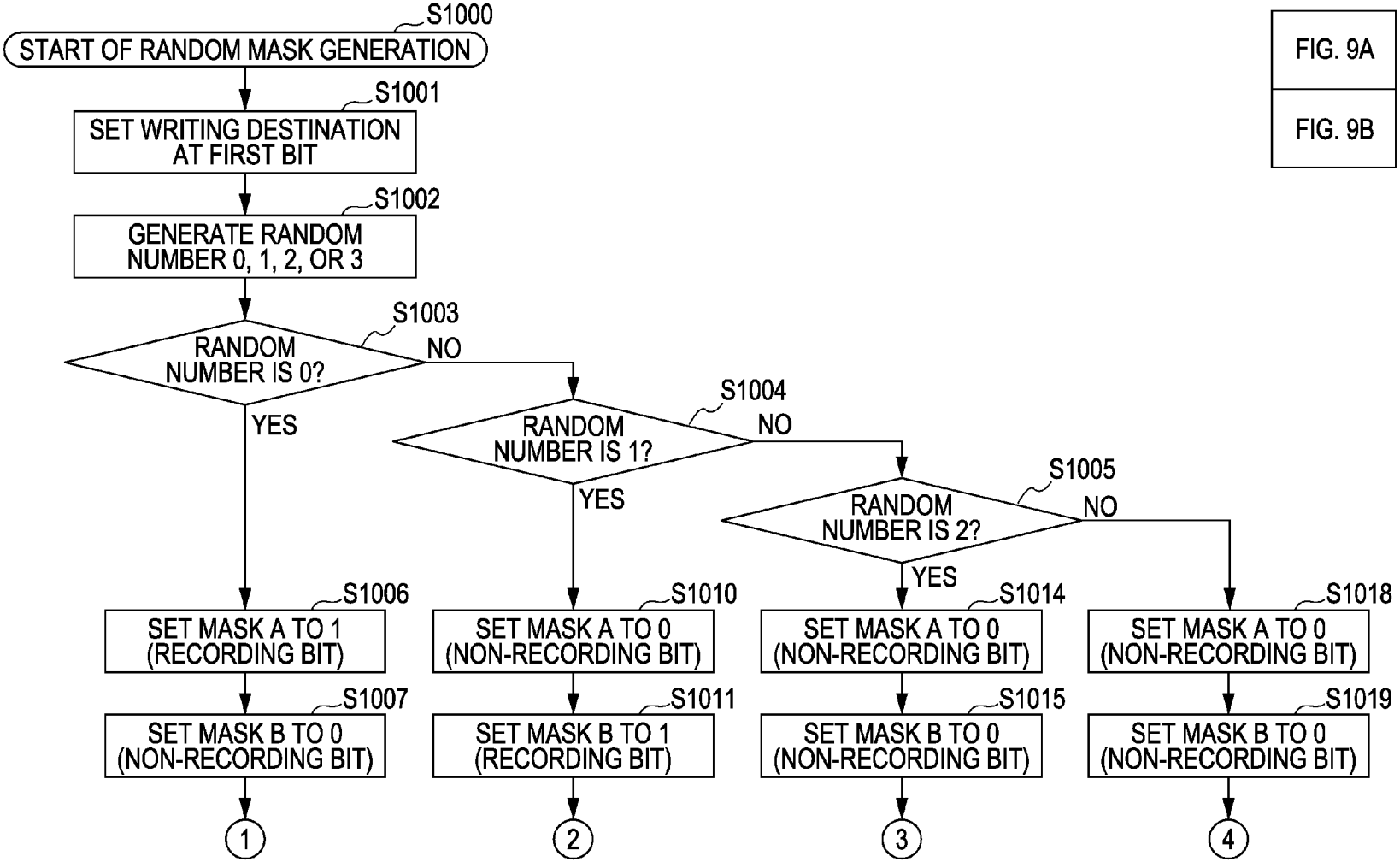
FIG. 9 is a flow chart showing a procedure to generate a random mask.
Figure 9B:
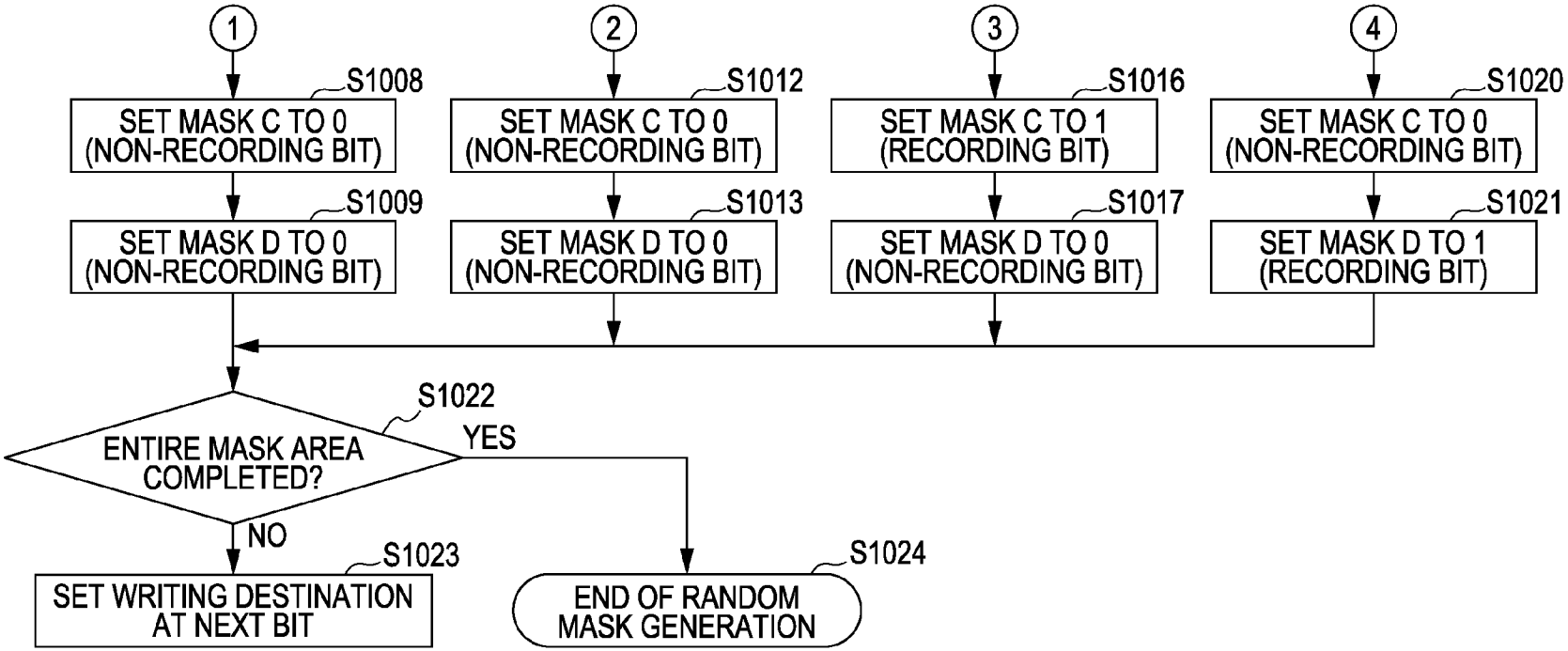

FIG. 9 is a flow chart showing a procedure to generate a random mask of this embodiment.

The generation of a random mask is started in step S1000. Next, in step S1001, the mask setting start position is set at the first bit of each mask. That is, for the mask A, the mask setting start position is (H, V)=(0, 0); for the mask B, (H, V)=(16000, 0); for the mask C, (H, V)=×2, 0); and for the mask D, (H, V)=(16000×3, 0). Next, in step S1002, a random number 0, 1, 2, or 3 is generated. Next, in steps S1003, S1004, and S1005, a mask for which a recording bit is set is determined according to the value of the random number. If the random number is 0, according to the determination in step S1003, the processing of steps S1006, S1007, S1008, and S1009 is executed. Specifically, in step S1006, 1 is set for the mask A to form a recording bit. A recording bit enables the data of a pixel of image data corresponding to a pixel of a mask. If, for example, the two-valued data of the pixel is "1," this means that a dot is formed in the pixel. In contrast, a non-recording bit enables the data of a corresponding pixel. Next, in steps S1007, S1008, and S1009, 0 is set for the mask B, mask C, and mask D to form a non-recording bit. Likewise, if the random number is 1, a recording bit is set for the mask B, while a non-recording bit is set for the other masks. If the random number is 2, a recording bit is set for the mask C, while a non-recording bit is set for the other masks. If the random number is 3, a recording bit is set for the mask D, while a non-recording bit is set for the other masks. Every time the mask setting is done for a pixel, it is determined in step S1022 whether or not the setting is completed throughout all areas of the mask. That is, it is determined whether or not the current setting position of the mask A is (H, V)=(16,000, 16). If it is determined in step S1022 that the setting is not completed throughout all areas of the mask, the flow proceeds to step S1023. In step S1023, the next setting position on the mask is specified. Specifically, the current V coordinate is incremented by one. However, if the current V coordinate is 16, V is set to 1 and the H coordinates of the mask A, mask B, mask C and mask D are incremented by one. After the processing in step S1023, the flow proceeds to step S1002 to repeat the above processing. If it is determined in step S1022 that the setting is completed throughout all areas of the mask, the flow proceeds to step S1024 to finish the process of generating a random mask.

The generated random mask is set for a recordable area on a recording medium. So, the coordinates of the recordable area on the recording medium are defined as Hp in the main scanning direction and Vp in the sub-scanning direction.

This recording apparatus analyzes a command of print data transferred through the I/F 611 (FIG. 3) from the host device 610 and expands it in the RAM as image data to record. An expansion area (expansion buffer) for the image data is secured on the RAM. This area has a horizontal size corresponding to Vp pixels of the recordable area and a vertical size of 16n pixels, which is one fourth of 64n pixels, the vertical size of an area recorded in one scan of the recording head. In addition, a storage area (print buffer) that the recording head references during recording scanning is secured on the RAM. This area has a horizontal size corresponding to Vp pixels of the recordable area and a vertical size of 64n pixels, which corresponds to the vertical size of an area recorded in one scan of the recording head.

The ASIC of this recording apparatus has a function of specifying the H coordinate of the start position of a random mask in the horizontal direction of the print buffer in units of 16 pixels in the vertical direction of the print buffer. In addition, the ASIC has a function of returning to the first bit of the random mask upon reaching the end of the random mask in the horizontal direction of the recording area. That is, H=0 to 16,000 in the horizontal direction of the random mask are repeatedly allocated to the horizontal direction of the recording area.

On the basis of the above configuration, during scanning of the recording head, the ASIC, matching the image data in the print buffer and the data of the random mask, directly referencing the storage area, performs a logical AND operation on both data and transfers driving data to the recording head.

Since in this embodiment an image in a predetermined area is completed in four scans, an image corresponding to one fourth of the vertical size of the recording head is completed in one scan of the recording head. Thus, after one scan of the recording head, one fourth of the image data expanded in the print buffer on the downstream side in the recording medium conveying direction becomes redundant. Thus, the redundant area in the print buffer is used as an expansion buffer for expanding image data, while the storage area used as an expansion buffer is used as one-fourth of the print buffer. That is, the storage area is managed in units of one fourth of the width recorded in one scan of the recording head. The five areas to manage are used in rotation as an expansion buffer and a print buffer.

Figure 10:
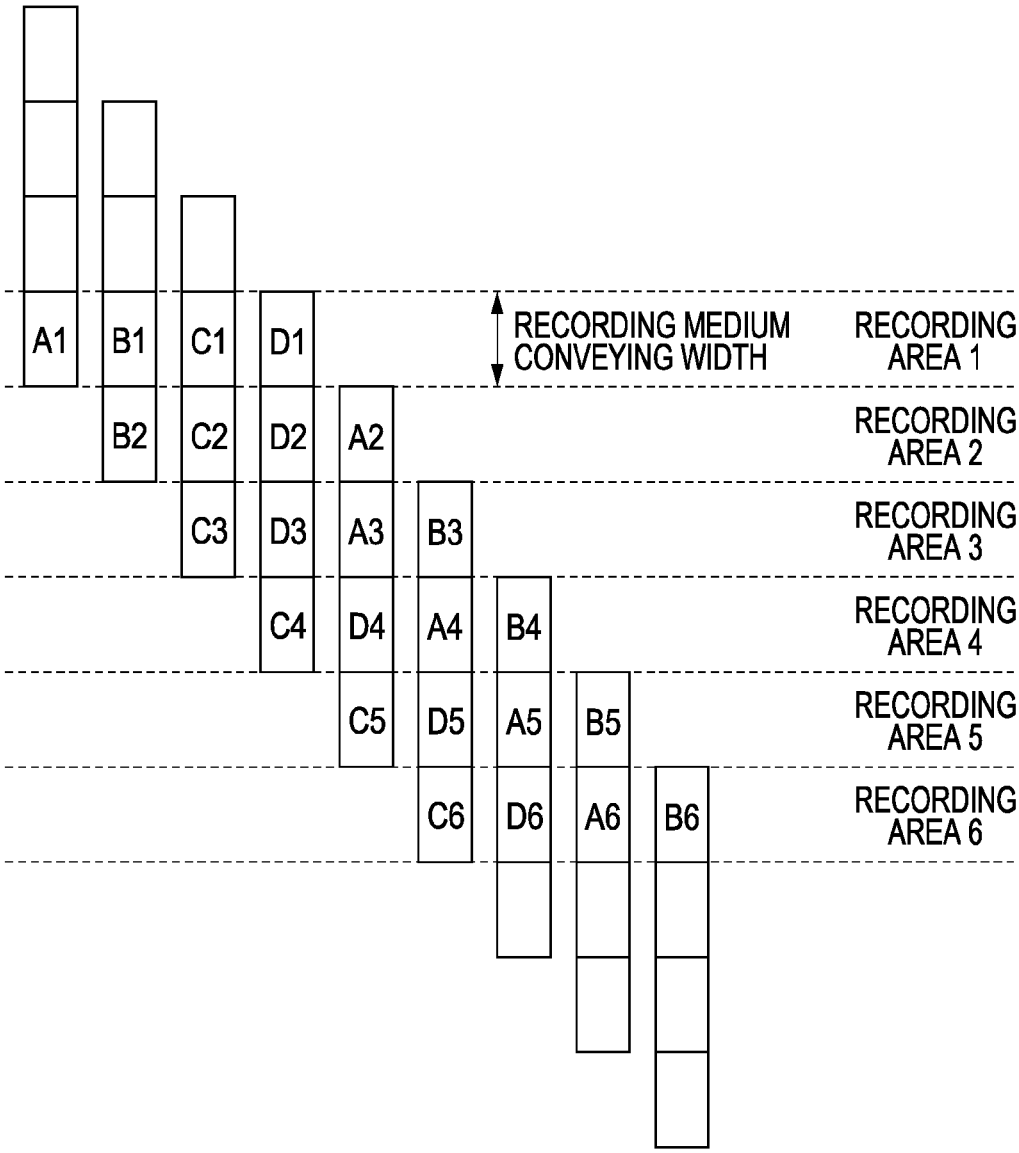
FIG. 10 shows multi-pass recording and a mask pattern used therefor.

FIG. 10 illustrates a recording operation in this embodiment and masks used in each scan of the operation. In the figure, dashed lines show the distance by which a recording medium is conveyed in one sub-scan (paper feed). As described above, the distance of conveyance in one sub-scan in the four pass recording of this embodiment is 16n pixels, which corresponds to one fourth of the vertical size recorded in one scan of the recording head. In the figure, the recording head performs scanning in the horizontal direction, and a recording medium is conveyed upward. In FIG. 10, reference numerals such as A1, B1, C1, and D1 are the management numbers of start points of the random masks A, B, C, and D in the recording area. Since the masks have different start points, different masks are used for respective recording areas and respective scans. In the same recording area, the four masks are complementary to each other. The same number indicates that the start position of the random mask is offset by 16,000 pixels in the horizontal direction.

Characteristic Configuration

The present invention is premised on a recording apparatus that performs recording using two or more achromatic inks (for example, gray ink in addition to black ink) and one or more chromatic inks. The characteristic configuration of the present invention is that, as shown in FIG. 3, gray nozzle rows g1 and g2 are disposed more laterally in the recording head than nozzle rows that eject one of the chromatic inks (for example, cyan rows c1 and c2). That is, the distance in the scanning direction between two nozzle rows of a predetermined achromatic ink is larger than the distance in the scanning direction between two nozzle rows of a predetermined chromatic ink. Due to such a recording head configuration, the present invention can perform high quality image recording that is uniform in color. A description thereof will hereinafter be given in detail.

Figure 11:
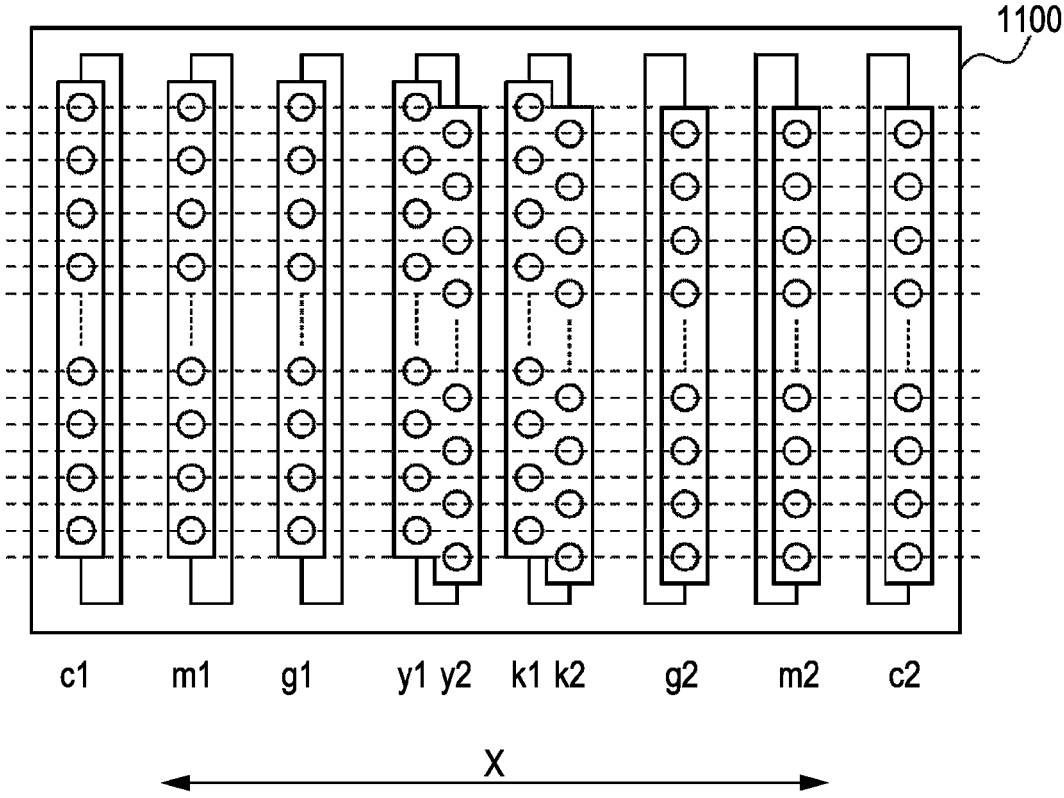
FIG. 11 shows the arrangement of ejection orifice rows in a color ink chip of a recording head that is a comparative example of the present invention.

FIG. 11 is a configuration diagram of a recording head that is a comparative example of this embodiment. FIG. 11 shows the arrangement of ejection orifice rows for achromatic (gray and black) inks and chromatic (cyan, magenta, and yellow) inks. In the recording head of FIG. 11, gray nozzle rows g1 and g2 that eject achromatic ink are disposed more medially than nozzle rows c1, c2, m1, m2 that eject chromatic ink.

Figure 12:
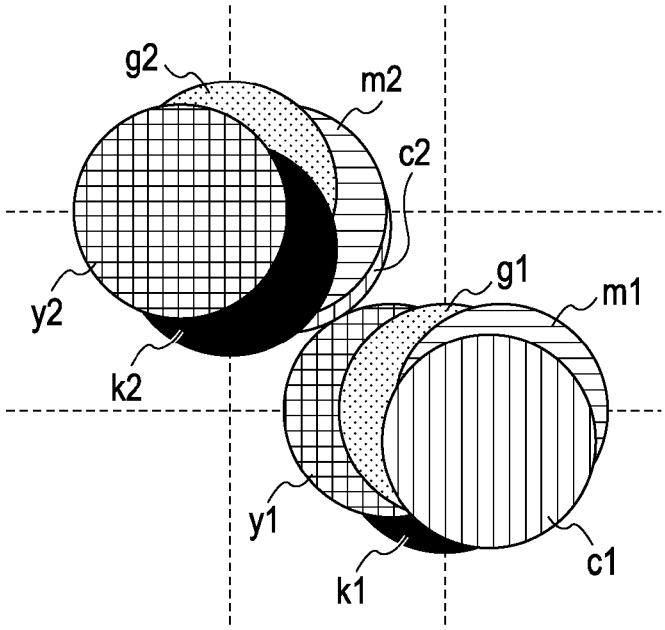
FIG. 12 shows the application order of a plurality of inks when the recording head of FIG. 11 is used.

FIG. 12 shows the ink application order when the recording head shown in FIG. 11 scans in the direction X1. In each scanning of the recording head, a combination of dots overlapping in the order of c2, m2, g2, k2, and a combination of dots overlapping in the order of y2 and k1, y1, g1, m1, and c1 are formed. When ink droplets of a plurality of colors land on the same place or places near each other, color appearance varies depending on the order in which the ink droplets land and the difference in the time of landing. Color appearance also varies and density and color shade greatly vary depending on the overlapping rate and arrangement of dots.

Figure 13:
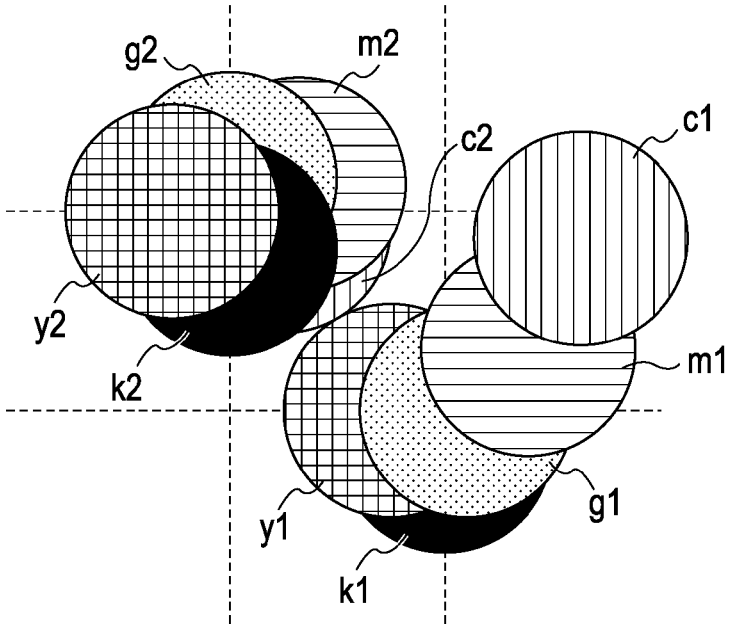
FIG. 13 shows the application order and positions of ink dots when landing positions deviate in the recording head of FIG. 11.

FIG. 13 shows, when the recording head of FIG. 11 is oblique to the scanning direction, how ink droplets ejected from the ejection orifice rows land on a recording medium. FIG. 13 differs greatly from FIG. 12 in the rate at which each dot overlaps with dots of other colors and the relative positional relationship between dots of the same color. The color appearance of a part overlapping with dots of other colors greatly differs from that of a part not overlapping with dots of other colors. Therefore, the dots of FIG. 12 greatly differs from the dots of FIG. 13 in graininess and color shade.

As described above, if the landing positions of ink droplets of the same color vary greatly between different ejection orifice rows, this variation strongly influences the difference in color between the two combinations of dots, and consequently causes image deterioration such as color nonuniformity and streaks.

Figure 14A:
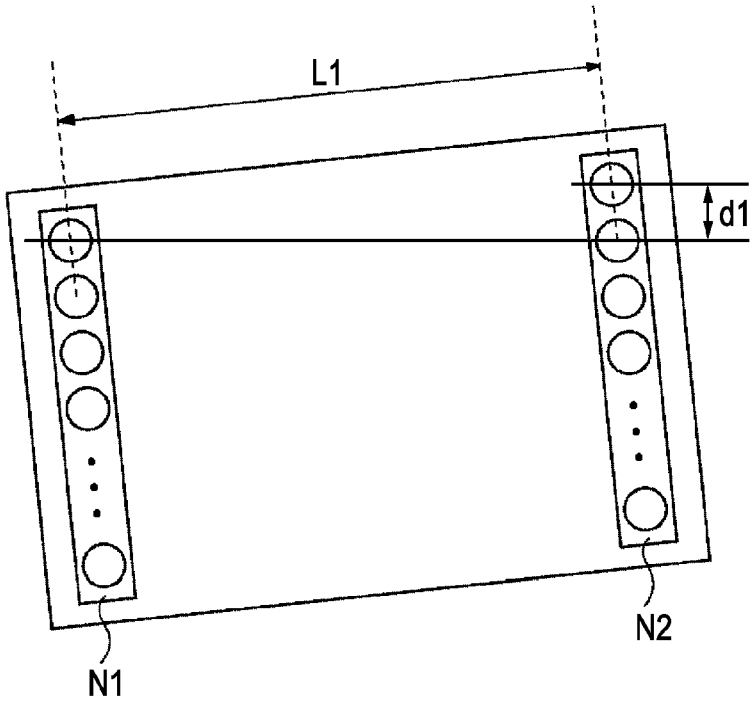
FIGS. 14A and 14B illustrate the relationship between the distance between ejection orifice rows and the difference in dot landing position.
Figure 14B:
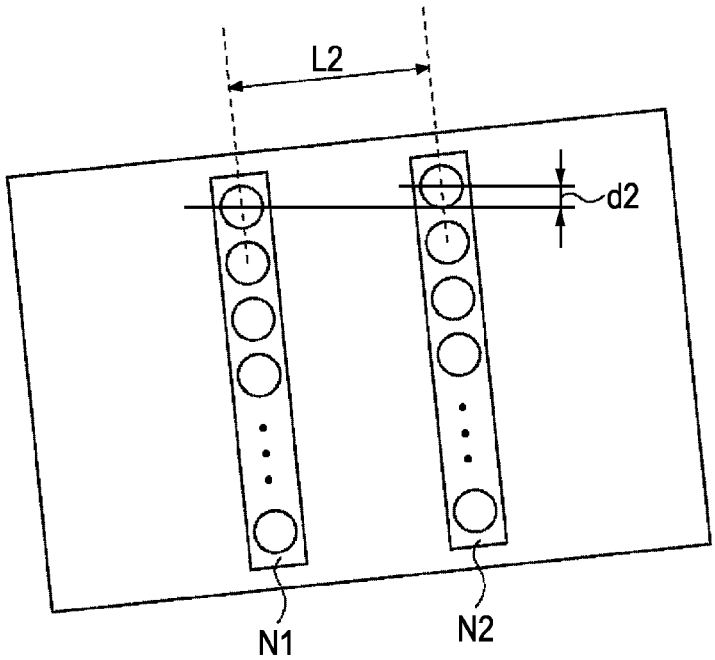

FIGS. 14A and 14B illustrate the difference in dot landing position in the sub-scanning direction when the recording head is oblique to the scanning direction. In FIG. 14A, the distance between two nozzle rows N1 and N2 is relatively large. In FIG. 14B, the distance is relatively small.

In FIG. 14A, the distance between two nozzle rows N1 and N2 in the scanning direction is L1. In this case, the difference in dot landing position in the sub-scanning direction corresponds to the difference d1 in nozzle position in the sub-scanning direction. On the other hand, as shown in FIG. 14B, when the distance between two nozzle rows N1 and N2 in the scanning direction is L2 (L2<L1), the difference in dot landing position in the sub-scanning direction corresponds to the difference d2 in nozzle position smaller than in FIG. 14A.

As is clear from above, when the recording head is oblique, the smaller the distance between nozzle rows in the scanning direction, the smaller the difference in dot landing position in the sub-scanning direction. Therefore, the distance between two nozzle rows that eject achromatic ink should be minimized to reduce influence on the image quality. In contrast, the distance between two nozzle rows that eject chromatic ink may be relatively large because if the distance between nozzle rows for chromatic ink is large and the difference in dot position in the sub-scanning direction is large, the image quality is little affected.

So, in this embodiment, as shown in FIG. 3, the distance between two nozzle rows (first and second ejection orifice rows) for a predetermined achromatic ink is larger than the distance between two nozzle rows (third and fourth ejection orifice rows) for a predetermined chromatic ink. Due to this, if the recording head is oblique and the dot landing positions vary, the variation in landing position of achromatic ink dots, which greatly influence the color shade of an image, can be reduced.

Image deterioration such as color nonuniformity and streaks is noticeable when the landing positions of dots of ink with low lightness vary. That is, for example, color nonuniformity is not noticeable when the landing positions of dots of ink with high lightness vary. Therefore, when the lightness of achromatic color is higher than the lightness of chromatic ink, image deterioration such as streaks is significantly reduced.

Figure 15:
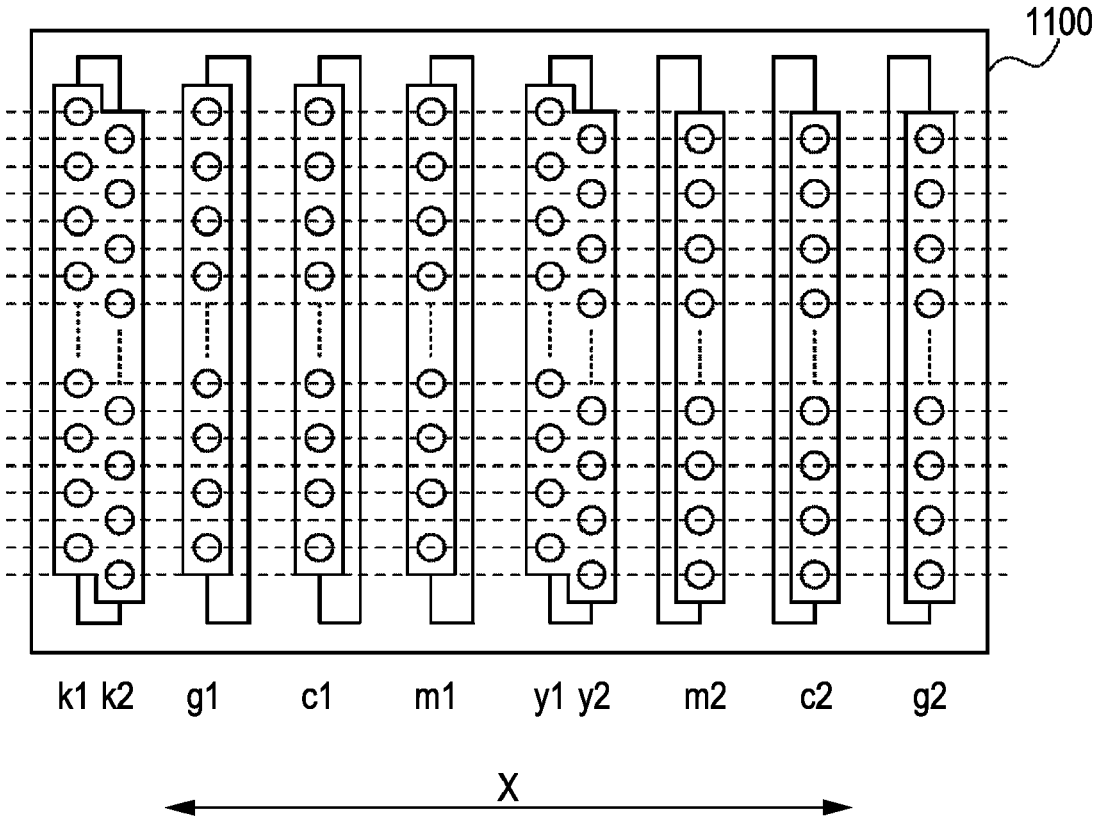
FIG. 15 shows the arrangement of ejection orifice rows in a color ink chip of a recording head used in another embodiment of the present invention.

In the configuration of the recording head shown in FIG. 3, every pair of nozzle rows that eject ink of the same color are disposed symmetrically. However, as shown in FIG. 15, as long as the distance between ejection orifice rows for gray ink is larger than the distance between ejection orifice rows for any one of chromatic inks, ejection orifice rows for dye black ink need not be disposed symmetrically.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-165075 filed Jun. 24, 2008, which is hereby incorporated by reference herein in its entirety.

What is claimed is:

1. An ink jet recording apparatus comprising:

a recording head chip that ejects two or more colors of achromatic inks and one or more colors of chromatic inks; and a scanning unit that makes the recording head chip scan a recording medium, wherein the recording head chip has first and second ejection orifice rows that eject a predetermined achromatic ink and third and fourth ejection orifice rows that eject a predetermined chromatic ink, and wherein in the direction of scanning of the recording head chip, a distance between the first ejection orifice row and the second ejection orifice row is larger than a distance between the third ejection orifice row and the fourth ejection orifice row.

2. The ink jet recording apparatus according to claim 1, wherein the distance between the first and second ejection orifice rows is larger than the distance between any other two ejection orifice rows provided in the recording head chip and ejecting the same color of ink.

3. The ink jet recording apparatus according to claim 1, wherein the first and second ejection orifice rows are provided the most outside in the scanning direction of all ejection orifice rows provided in the recording head chip.

4. The ink jet recording apparatus according to claim 1, wherein the first ejection orifice row is disposed symmetrically to the second ejection orifice row and the third ejection orifice row is disposed symmetrically to the fourth ejection orifice row with respect to the same axis of symmetry.

5. The ink jet recording apparatus according to claim 1, wherein recording is performed by making the recording head chip scan a predetermined area on the recording medium a plurality of times.

6. The ink jet recording apparatus according to claim 1, wherein recording is performed so that the number of pixels recorded in the order of the predetermined chromatic ink and the predetermined achromatic ink is substantially the same as the number of pixels recorded in the order of the predetermined achromatic ink and the predetermined chromatic ink in one scan of the recording head chip.

7. The ink jet recording apparatus according to claim 1, wherein the lightness of the predetermined achromatic ink is higher than the lightness of the predetermined chromatic ink.

8. The ink jet recording apparatus according to claim 1, wherein the predetermined achromatic ink is gray ink, and the predetermined chromatic ink is one of yellow ink, cyan ink, and magenta ink.

9. The ink jet recording apparatus according to claim 1, wherein the two or more colors of achromatic inks are gray ink and black ink, and the one or more colors of chromatic inks are cyan ink, magenta ink, and yellow ink.

10. An ink jet recording head chip that ejects two or more colors of achromatic inks and one or more colors of chromatic inks, the recording head chip comprising:

first and second ejection orifice rows that eject a predetermined achromatic ink; and third and fourth ejection orifice rows that eject a predetermined chromatic ink, wherein in the direction of scanning of the recording head chip, a distance between the first ejection orifice row and the second ejection orifice row is larger than a distance between the third ejection orifice row and the fourth ejection orifice row.

* * * * *